US011702320B2

(12) United States Patent
Lo Jacono

(10) Patent No.: US 11,702,320 B2
(45) Date of Patent: Jul. 18, 2023

(54) CAR SKIRT OF AN ELEVATOR INSTALLATION

(71) Applicant: Inventio AG, Hergiswil (CH)

(72) Inventor: Romeo Lo Jacono, Gravesano (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 17/754,064

(22) PCT Filed: Sep. 1, 2020

(86) PCT No.: PCT/EP2020/074264
§ 371 (c)(1),
(2) Date: Mar. 23, 2022

(87) PCT Pub. No.: WO2021/063608
PCT Pub. Date: Apr. 8, 2021

(65) Prior Publication Data

US 2022/0332546 A1 Oct. 20, 2022

(30) Foreign Application Priority Data

Sep. 30, 2019 (EP) ..... 19200473

(51) Int. Cl.
*B66B 13/28* (2006.01)

(52) U.S. Cl.
CPC ..... *B66B 13/285* (2013.01)

(58) Field of Classification Search
CPC ..... B66B 13/285
See application file for complete search history.

(56) References Cited

U.S. PATENT DOCUMENTS

2009/0277725 A1* 11/2009 Rasanen ..... B66B 13/285 187/400
2014/0020986 A1* 1/2014 Delachatre ..... B66B 13/285 187/400

FOREIGN PATENT DOCUMENTS

DE 10065101 A1 * 7/2002 ..... B66B 13/285
DE 10115990 C1 * 10/2002 ..... B66B 13/285
DE 202011051638 U1 1/2012
EP 1118576 A2 7/2001
EP 1772414 A1 4/2007
KR 20190000094 A 1/2019

* cited by examiner

*Primary Examiner* — Minh Truong
(74) *Attorney, Agent, or Firm* — William J. Clemens; Shumaker, Loop & Kendrick, LLP

(57) ABSTRACT

An elevator installation includes an elevator shaft provided with shaft doors and a car moveable up and down in the shaft. The car has a car skirt moveable between a horizontal rest position and a vertical blocking position. The car skirt is pivotally and displaceably mounted on the car by a guideway. When the car skirt is in the blocking position, it can be supported on an adjacent one of the shaft doors.

12 Claims, 3 Drawing Sheets

CAR SKIRT OF AN ELEVATOR INSTALLATION

FIELD

The invention relates to an elevator installation with a car having a car skirt that can be moved between a horizontal rest position and a vertical blocking position.

BACKGROUND

Elevator installations for conveying people and goods contain cars that can be moved up and down in an elevator shaft. The cars can be moved by means of a drive unit using suspension means, for example in the form of suspension cables or suspension belts. As a result of malfunctions or emergency stops, the car may become stuck between the floors. In such incidents, the trapped people must be evacuated from the car to the next stop. In this case, a gap could arise between the underside of the car and the floor, and people could fall through this gap during the evacuation into the shaft. In order to avoid such incidents, the cars are equipped with car skirts. There are various sets of rules with precise specifications for the design of car skirts for the elevator industry. Rigid car skirts have been known and used for a long time. European standard EN 81-20:2014 stipulates in section 5.4.5 that the vertical length of the skirt must be at least 750 mm and that the skirt must be designed to be so stable that there is virtually no yielding in the case of a force of 300 N applied at a point.

For some time now, elevator installations with reduced shaft pit depths have become increasingly popular. In order to allow the shaft pit depth to be reduced, the car skirts are designed to be movable. Pivotable and foldable car skirts are known from EP 1 118 576 A2. In practice, it has been shown that the high requirements in terms of stability can be achieved only with great effort with the known car skirts.

SUMMARY

It is therefore an object of the present invention to avoid the disadvantages of the known elevator installation and in particular to provide an elevator installation with which the evacuation of people from the car can be ensured in a safe manner. In particular, the car skirt used for this purpose should be simple and inexpensive and meet high stability requirements.

According to the invention, this problem is solved by an elevator installation having an elevator shaft and a car that can be moved up and down in the elevator shaft preferably along guide rails. The car has a movable car skirt, the car skirt being able to be moved between a horizontal rest position and a vertical blocking position. The car skirt, when it is in the blocking position, can be supported on one of the shaft doors. Movable car skirts are particularly advantageous for elevator installations with shallow pit depths or for elevators without a pit. Shaft doors can be provided on each floor in order to allow passengers and goods access to the car.

The car skirt is designed in such a way that there are a plurality of advantages resulting from the fact that the skirt, when it is in the blocking position, can be supported on one of the shaft doors when horizontal forces are exerted from the outside by people getting out of the car interior for evacuation. The car skirt is characterized by a high level of stability. By virtue of the support, it is ensured that undesired yielding into the shaft interior can be easily prevented by the floor-side action on the car skirt, for example if a person presses against the skirt as a result of falling during an evacuation of people from the car. Furthermore, the arrangement makes it possible, in a reliable manner, for even strict standard requirements to be easily met. Elaborate and costly structural measures for the stable and rigid attachment of the car skirt to the car can be dispensed with. In particular, it is not necessary to provide additional or special locking means in order to secure the blocking position of the car skirt.

In the rest position, the car skirt can be positioned in a substantially horizontal position below the car close to the underside of the car; in the blocking position, the car skirt for blocking the gap between the car and the floor can preferably be directed in a vertical position downward toward the shaft pit, the car skirt preferably extending in parallel with the shaft wall on the shaft door side.

The rest position corresponds to a position for normal operation, in which position the car skirt is positioned close to an underside of the car. In this rest position, there would be a gap between the car and the floor if the car were to become stuck between the floors. This gap must be closed in order to safely evacuate the trapped people from the car. To do this, the car skirt is moved down into the blocking position. The blocking position is the position for closing the gap between the floor and the underside of the car, thus preventing people from falling from the floor into the elevator shaft via an open shaft door.

Two guide rails for guiding the car can be provided in the elevator shaft. The guide rails can preferably be arranged opposite one another on corresponding shaft walls of the elevator shaft.

The car can also have a car door. The car can have a front side, a rear side opposite the front side and parallel car sides connecting the front side and rear side. As a rule, the car door and thus also the car skirt are arranged in the region of the front side.

Guide rails for guiding the car can be attached to shaft walls which are adjacent to the above-mentioned two parallel car sides. The guide rails can be positioned in the shaft in such a way that, in a top view, they lie approximately in the center of these car sides.

Controllable or manually operable securing means can be provided on the car, by means of which securing means the car skirt is held in the rest position securely on the car in the horizontal position close to the underside of the car. The car skirt can also be designed in such a way that, after it has been enabled or released by appropriate control or operation of the securing means, the car skirt can be moved into the blocking position.

The car skirt can preferably be designed to be movable about a horizontal pivot axis. The car skirt can also have a blocking segment which projects downward in the blocking position in order to close the gap between the floor and the underside of the car and a support segment which adjoins the blocking segment at the pivot axis and projects upward in the blocking position in order to positionally secure the vertical position of the car skirt. The support segment is the element of the car skirt which is supported on the shaft doors when horizontal forces are exerted from the outside for example by people getting out of the car interior during an evacuation. When the stated force is exerted, the free upper end of the support segment abuts the relevant shaft door and thus prevents an undesired movement of pivoting further backward.

The car skirt can be a flat skirt element, the flat skirt element comprising the aforementioned blocking segment and the support segment which adjoins the blocking segment and is preferably on the same plane. When the car skirt is in the blocking position, the support segment forms a stop to prevent the car skirt from pivoting back toward the underside of the car when horizontal forces are exerted from the outside by people getting out of the car interior.

To a certain extent, the support segment forms a protruding part of the car skirt. To reliably ensure a stable blocking position of the car skirt, it is advantageous if the support segment has a length of at least 10 cm. The length mentioned is measured starting from the pivot axis as far as the free end or the upper edge of the car skirt.

In a preferred embodiment, the car skirt is pivotally and displaceably mounted by means of a guideway. Thanks to the pivoting and sliding movement, it is easily possible to move the car skirt from the rest position, in which the car skirt is positioned below the car in a horizontal position close to the underside of the car, and into the blocking position, in which the car skirt extends in a vertical position in parallel with the shaft wall on the shaft door side and close to the shaft door.

The guideway can be formed, for example, by a groove or a rail. The car preferably has two opposite guide grooves or guide rails, the guide grooves or guide rails being arranged in the region of the car floor on the opposite parallel car sides.

The guideway can have a guide portion. Using the guide portion, the car skirt can be easily displaced and thus the horizontal distance to the shaft door can be easily bridged. The guide portion can have a linear or curved course.

The guideway can have an oblique, preferably linear, guide portion. The oblique guide portion is inclined with respect to the horizontal. The oblique course ensures that the car skirt can be moved into the blocking position due to the force of gravity. After being enabled or released by appropriate control or operation of the securing means, the car skirt can be automatically, and only under the effect of gravity, brought into the blocking position.

Furthermore, the guideway can have a vertical end portion which adjoins the guide portion. The end portion ensures that the car skirt cannot easily be pushed back by applying a horizontal force. To restore the initial position, the skirt must first be lifted, i.e., moved slightly upward in a vertical direction until a curve point is reached from which the skirt can be displaced further backward by the guide portion, the skirt being pivoted upward during or after the second-mentioned sliding movement.

The end portion, which is preferably short in comparison with the guide portion, can have a linear or curved course.

The end portion can have a front end for setting the blocking position. This front end corresponds to an end point of the guideway. The front end forms the lowest point of the guideway so that the pivot axis of the car skirt is temporarily fixed. The front end of the end portion is positioned in such a way that, in the blocking position, the vertical car skirt extends close to and almost in parallel with the shaft door. Temporarily fixed here means that when horizontal forces are exerted, the car skirt can only be pivoted. However, since the front end of the end portion is preferably arranged so close to the shaft wall on the shaft door side, the pivoting movement is substantially prevented or only a slight pivoting movement is possible since the shaft door abuts the shaft door.

The car skirt can have a pair of articulated cams for setting the pivot axis, which cams engage in a pair of parallel guide grooves on the car that form the guideway. Of course, other structural configurations are also conceivable. For example, the car skirt can have a continuous axle shaft for setting the pivot axis that engages in guide grooves on the car.

The car skirt can have a central, preferably approximately rectangular, cutout in the region of the support segment. Such a design can make sure that the support segment has a sufficient length, but due to the cutout, there is no disruptive obstacle at the door threshold. This ensures that the car opening is completely free when the car doors are open, even with extra-long support segments.

DESCRIPTION OF THE DRAWINGS

Further individual features and advantages of the invention can be derived from the following description of embodiments and from the drawings, in which.

DETAILED DESCRIPTION

Figure 1:
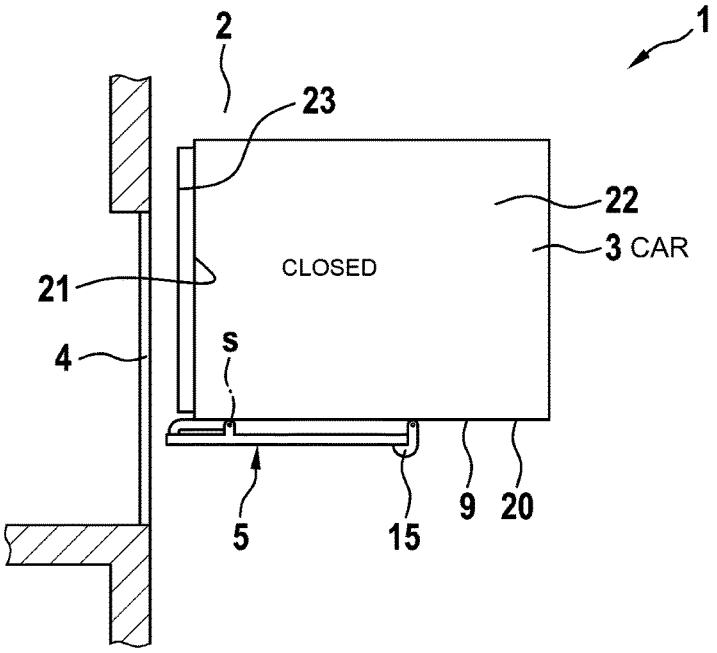
FIG. 1 is a greatly simplified view of an elevator installation according to the invention having a car which can be moved up and down in an elevator shaft and is equipped with a movable car skirt, with the car skirt being in a rest position.

FIG. 1 shows an elevator installation, denoted by 1, for a multi-story building. The building has one elevator shaft 2 or multiple elevator shafts as required. The elevator installation 1 shown here contains a car 3 that can be moved vertically up and down in the elevator shaft 2 for the transport of people or goods to individual floors. The car 3 has a car floor 9, a car roof, a front side 21, a rear side opposite the front side and parallel car sides 22 connecting the front side and rear side. A car door 23 is arranged in the region of the front side 21.

A shaft door 4 is associated with each floor. In addition to the car 3, the elevator installation generally has a counterweight, suspension means and a drive, which are not shown here for the sake of simplicity and for reasons of clarity. The drive (e.g., a traction sheave drive) drives the one or more suspension means (for example belts or steel cables) and thus moves the car 3 and the counterweight in opposite directions. To guide the car 3, guide rails (also not shown here) are arranged in the elevator shaft 2.

Figure 3:
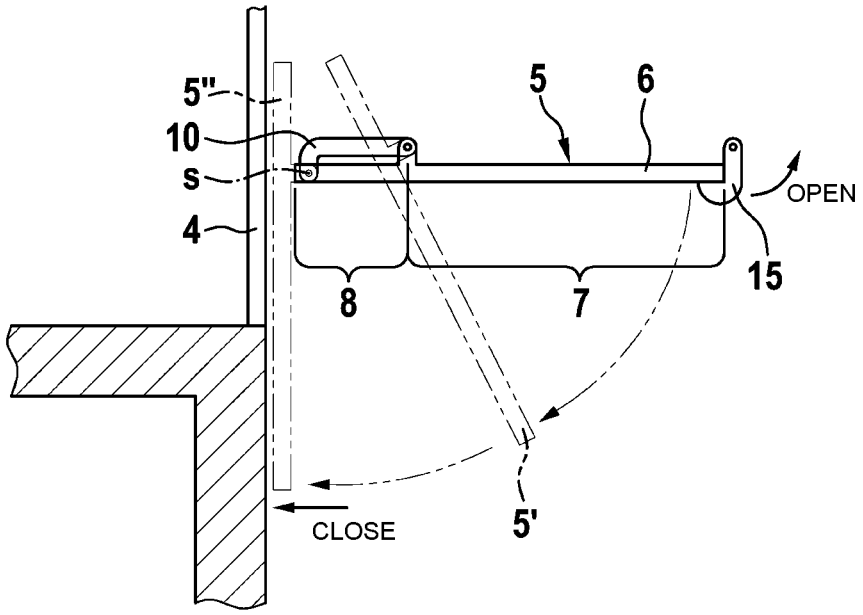
FIG. 3 is an enlarged view of a car skirt for the elevator installation according to the invention.

A special car skirt 5, which is described in detail below, is arranged below the car 3. In FIG. 1, the car skirt is in a rest position close to the car 3, and the car skirt is normally located in this position. In the rest position, the car skirt is clearly positioned in a horizontal position below the car 3 close to the underside 20 of the car. The car skirt 5 is brought into a blocking position only in special situations, for example for emergency evacuations of people from the car 3. FIG. 1 shows the car 3 in a position between the floors, in which such an emergency evacuation may be necessary. In order for people to be able to safely get out of the car 3 and reach the next floor, the car skirt 5 must be moved from the rest position shown in FIG. 1 to the blocking position. This movement takes place after securing means 15 for holding the car skirt 5 in the rest position have first been triggered. The car skirt 5 is then moved in two phases and brought into the blocking position shown in FIG. 3. The blocking position is the position in which the car skirt 5 blocks or covers the gap between the car and the floor. In the blocking position, the car skirt 5 is clearly directed downward in a vertical position. In the blocking position, the car skirt 5 extends in parallel with the shaft wall on the shaft door side.

The aforementioned securing means 15 can, for example, comprise one or at most a plurality of pawls, by means of which the car skirt 5 can be held in the rest position on the car 3 in the horizontal position on the underside 20 of the car 3. The securing means 15 can be controlled or can be operated manually to lift the rest position.

Figure 2:
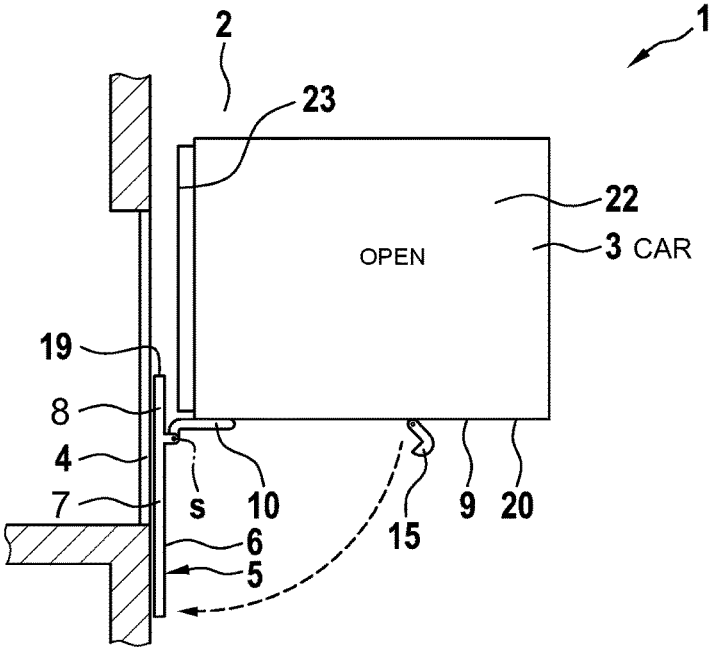
FIG. 2 shows the elevator installation from FIG. 1, with the car skirt of the car being in a blocking position.

As can be seen from FIG. 2, the car skirt 5 is pivotally and displaceably mounted on the car 3 by means of a guideway 10. The sequence of movements of the car skirt 5 is indicated by dashed lines in FIGS. 2 and 3. First, the car skirt 5, after it has been enabled by the securing means 15, falls downward and then pivots. This position of the car skirt is indicated by 5'. The car skirt 5 is then displaced in the direction of the shaft wall on the shaft door side until it finally reaches the end position shown by 5".

The guideway 10 can be formed, for example, by a groove. The pivot axis for the pivoting movement is denoted by S. The guideway 10 comprises a linear guide portion 11 (see FIG. 4). In the end position, the horizontal pivot axis S is positioned slightly below with respect to the guide portion 11. For the end position, a downwardly directed and comparatively short vertical end portion 13 adjoins the horizontal guide portion 11. In this position, the car skirt 5" cannot easily be pushed back in the horizontal direction such that the car skirt 5" is pivotally mounted on the car 3 in a more or less stable manner. If a horizontal force is exerted on the car skirt 5" from the outside, for example by people getting out of the car interior, the pivot axis S cannot retreat in the horizontal direction; the pivot axis S is therefore at least temporarily fixed. When horizontal forces are exerted from the outside, there is a slight pivoting movement, but further pivoting movement is prevented since the upper free end 19 abuts the shaft door 4. The force mentioned here is indicated by an arrow F in FIG. 4.

Since the car skirt 5, when it is in the blocking position (5"), can be supported on the shaft doors 4 when horizontal forces are exerted from the outside, it is not necessary to provide additional or special locking means in order to secure the blocking position of the car skirt. The shaft doors 4 are usually designed as sliding doors. This ensures that the car skirt 5 can also be supported on the shaft door 4 when the shaft door 4 is open for evacuation.

So that the car skirt 5 can be brought back from the blocking position into the initial position, i.e., into the aforementioned rest position, the car skirt 5 must be raised. After the car skirt 5 has been moved slightly upward in the vertical direction, it can be pushed back again along the linear horizontal guide portion 11 of the guideway 10 into the horizontal intermediate position (5') at the start of the guideway 10. Finally, the car skirt 5 only has to be folded back up. If the securing means 15 have corresponding pawls for a latching connection, for example, the car skirt 5 latches on the pawl, the car skirt 5 is securely held in the rest position again as a result.

For a reliable and safe support of the car skirt 5 when it is in the blocking position, the car skirt 5 has a part that protrudes upward in relation to the pivot axis S. This protruding part is formed by a segment of the car skirt 5 referred to as a support segment 8. The car skirt 5 substantially consists of a flat skirt element 6 which is made up of a blocking segment 7 and the aforementioned support segment 8. The blocking segment 7 has the task of closing the gap between the floor and the underside 20 of the car. The blocking segment 7 and the support segment 8, which are preferably flush with one another and are thus on the same plane, form a common flat element.

As an example, an extension for forming the pivot axis S is attached to the flat skirt element 6. The extension can be monolithically connected to the flat skirt element 6. The extension can be equipped with an articulated cam, for example. In this case, the car skirt 5 can preferably have a pair of articulated cams which engage in a pair of parallel guide grooves to form the guideway 10 on the car 3.

Figure 4:
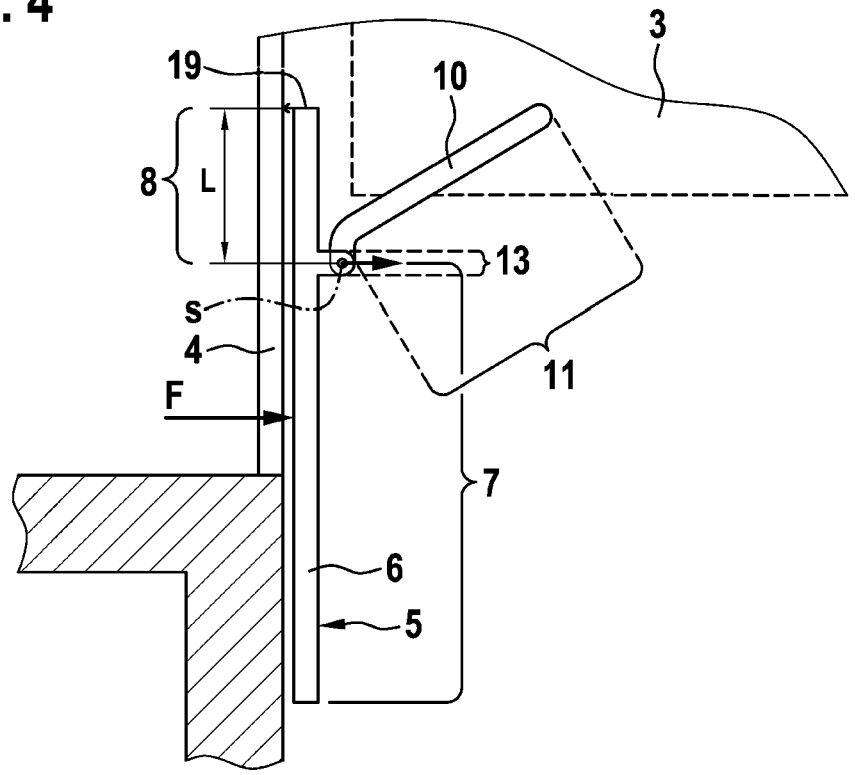
FIG. 4 is a variant of the car skirt according to FIG. 3.

A preferred variant of a guideway 10 for the pivotable and displaceable mounting of the car skirt 5 is shown in FIG. 4. The skirt element 6 of the car skirt 5 is designed substantially the same as in the first embodiment. The guideway 10 has an oblique linear guide portion 11 and a comparatively short, vertical linear end portion 13 which adjoins the guide portion 11. In the present case, the guide portion 11 is inclined, for example, by an angle of 30° with respect to the horizontal. The angle of inclination of the guide portion 11 with respect to the horizontal can preferably be between 10° and 45°.

As already mentioned, the car skirt 5 has a blocking segment 7 which adjoins the pivot axis S and projects downward in the blocking position in order to close the gap between the floor and the underside 20 of the car and a support segment 8 which adjoins the pivot axis S and projects upward in the blocking position in order to positionally secure the vertical position of the car skirt. The support segment 8 preferably has a length L, measured from the pivot axis S as far as the free upper end 19, of at least 10 cm.

The end portion 13 has a front end for setting the blocking position, the front end corresponding to an end point of the guideway 10. The front end forms the lowest point of the guideway 10.

In FIG. 4 it can be clearly seen that the pivot axis S is temporarily fixed in the blocking position. When the force is exerted, the car skirt 5 can only be pivoted. However, since the vertical car skirt 5, which extends almost in parallel with the shaft door 4, is practically directly next to the shaft door 4, the pivoting movement is substantially prevented or only a slight pivoting movement is possible since the car skirt 5 abuts the shaft door 4.

Figure 5:
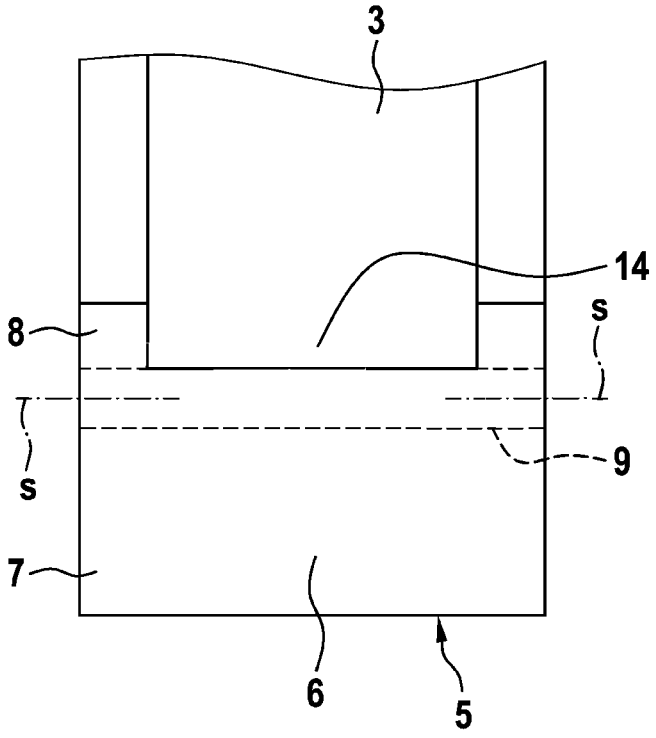
FIG. 5 is a front view of a car having a car skirt in the blocking position according to an embodiment.

It can be seen from the front view of the car 3 according to FIG. 5 that the car skirt 5 can have a central, preferably approximately rectangular, cutout 14 in the region of the support segment 8. If a particularly large length is selected for the support segment 8, the cutout 14 can ensure that no disruptive obstacles arise at the door threshold and therefore people can be evacuated from the car unhindered.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation including a car moveable up and down in an elevator shaft, the elevator shaft having a plurality of shaft doors, the car comprising:

a car skirt arranged on the car and being moveable between a horizontal rest position and a vertical blocking position;

wherein the car skirt is movable relative to the car about a horizontal pivot axis, the car skirt having a blocking segment that adjoins the pivot axis and projects downward when the car skirt is in the blocking position thereby closing a gap between a floor at which the one shaft door is located and an underside of the car, and the car skirt having a support segment that adjoins the pivot axis and projects upward when the car skirt is in the blocking position to positionally secure the car skirt vertically; and wherein when the car skirt is in the blocking position and the car is adjacent to one of the shaft doors, the car skirt is adapted to be supported on the one shaft door when a horizontal force is exerted onto the blocking segment causing an upper end of the support segment to pivot and abut against the one shaft door.

2. The elevator installation according to claim 1 wherein the support segment has a length of at least 10 cm.

3. The elevator installation according to claim 1 wherein the car skirt has a central, preferably approximately rectangular, cutout formed in a region of the support segment.

4. The elevator installation according to claim 3 wherein the central cutout is rectangular is shape.

5. The elevator installation according to claim 1 wherein the car skirt is pivotally and displaceably mounted on the car by a guideway.

6. The elevator installation according to claim 5 wherein the guideway has a guide portion for displacing the car skirt to bridge a horizontal distance between the car and the one shaft door.

7. The elevator installation according to claim 6 wherein the guide portion is an oblique guide portion.

8. The elevator installation according to claim 6 wherein the guideway has a vertical end portion that adjoins the guide portion.

9. The elevator installation according to claim 8 wherein the end portion has a front end for setting the blocking position of the car skirt, the front end forming a lowest point of the guideway such that the pivot axis of the car skirt is temporarily fixed in place.

10. An elevator car skirt for use in an elevator installation a car moveable up and down in an elevator shaft, the elevator shaft having a plurality of shaft doors, the car skirt comprising:

a guideway adapted to be attached to an underside of the car;

a skirt element being moveable along the guideway and being rotatable about a horizontal pivot axis at the guideway for movement between a horizontal rest position and a vertical blocking position;

wherein the skirt element has a blocking segment that adjoins the pivot axis and projects downward when the car skirt is in the blocking position thereby closing a gap between a floor at which the one shaft door is located and the underside of the car, and the skirt element has a support segment that adjoins the pivot axis and projects upward when the car skirt is in the blocking position to positionally secure the car skirt vertically; and wherein when the car skirt is attached to the car and in the blocking position and the car is adjacent to one of the shaft doors, the skirt element is adapted to be supported on the one shaft door when a horizontal force is exerted onto the blocking segment causing an upper end of the support segment to pivot and abut against the one shaft door.

11. The elevator car skirt according to claim 10 wherein the guideway has a guide portion for displacing the car skirt to bridge a horizontal distance between the car and the one shaft door, the guide portion extending one of horizontally and obliquely.

12. The elevator car skirt according to claim 11 wherein the guideway has a vertical end portion that adjoins the guide portion, the end portion having a front end for setting the blocking position of the car skirt, the front end forming a lowest point of the guideway such that the pivot axis of the car skirt is temporarily fixed in place.

* * * * *